US005315275A

United States Patent [19]

Hoffmann et al.

[11] Patent Number: 5,315,275

[45] Date of Patent: May 24, 1994

[54] ELECTROMAGNETIC RELAY AND METHOD OF ADJUSTING SAME

[75] Inventors: Wolfgang Hoffmann; André Körner, both of Lippstadt; Maik Zimmer, Erwitte, all of Fed. Rep. of Germany

[73] Assignee: Hella KG Hueck & Co., Lippstadt, Fed. Rep. of Germany

[21] Appl. No.: 160,198

[22] Filed: Dec. 2, 1993

[30] Foreign Application Priority Data

Dec. 23, 1992 [DE] Fed. Rep. of Germany ..... 4243841

[51] Int. Cl.[5] ..... H01H 51/22

[52] U.S. Cl. ..... 335/86; 29/622

[58] Field of Search ..... 335/78-86, 335/124, 128, 202; 29/622

[56] References Cited

U.S. PATENT DOCUMENTS

| | | | |
|---|---|---|---|
| 4,182,998 | 1/1980 | Mueller et al. | 335/151 |
| 4,368,574 | 1/1983 | Litt et al. | 335/622 |
| 4,533,889 | 8/1985 | Knight | 29/622 |
| 4,577,173 | 3/1986 | Schedele et al. | 335/81 |
| 4,742,610 | 3/1988 | Kimpel et al. | 29/622 |
| 4,870,378 | 9/1989 | Biehl et al. | 335/78 |
| 5,155,459 | 10/1992 | Schmid et al. | 335/128 |
| 5,177,459 | 1/1993 | Meister | 335/83 |
| 5,909,379 | 3/1992 | Kwapisz | 29/622 |

FOREIGN PATENT DOCUMENTS

| | | |
|---|---|---|
| 2705961A1 | 8/1977 | Fed. Rep. of Germany . |
| 3423271A1 | 1/1986 | Fed. Rep. of Germany . |

*Primary Examiner*—Lincoln Donovan

*Attorney, Agent, or Firm*—Griffin Butler Whisenhunt & Kurtossy

[57] ABSTRACT

An electromagnetic relay has a normally-open contact tongue (2) with at least one finger (24*a*) which, during mounting, is first slidably engaged in a drawer-cavity-forming element (25). After adjusting a normally-open contact (3) relative to a movable switch-contact (4*a*) the position of the at least one finger is affixed in the drawer-cavity-forming element so that the position of the normally-open contact is fixed. The relay of this invention is characterized by having a particularly uncomplicated structure and by allowing a particularly uncomplicated, cost-effective, and fully-automated adjustment of the normally-open contact.

9 Claims, 2 Drawing Sheets

ELECTROMAGNETIC RELAY AND METHOD OF ADJUSTING SAME

BACKGROUND OF THE INVENTION

This invention concerns an electromagnetic relay having a base plate through which a plurality of terminal tongues extend, with one of the terminal tongues being a normally-open contact tongue supporting a normally-open contact, with the normally-open contact tongue having a substantially L-shaped bend therein.

Particularly in modern motor vehicles which have a multiplicity of electronic apparatus, among other electrical components, many relays are employed. In this regard, small-size relays, so-called microrelays, which need very little mounting space and which, therefore, lend themselves particularly well to being integrated into complex electronic circuits, are increasingly preferred.

Naturally, when microrelays are employed, reliable operation and long life are demanded. At the same time, production costs of such relays should remain low. These requirements cause the following problems during manufacture of microrelays:

With the manufacture of large-size, or large structure, relays, generally manufacturing processes are preferred in which an adjustment of assembled relay components can be avoided because process steps necessary for such adjustments represent a substantial cost factor.

Particularly small-structure relays demand, contrary to large relays, a particularly exact fabrication method. Individual relay components can, therefore, because of their small sizes, have only small manufacturing tolerances so that the manufacture of such microrelays is disproportionately expensive. Experience has shown that it is more convenient, when manufacturing such microrelays, to allow larger manufacturing tolerances during manufacture of individual relay components and then to carry out adjustments when the components are assembled, that is, particularly adjusting the positions of the components relative to one another.

This method proves to be particularly cost-effective if the adjustments can be fully automatic during relay assembly.

To accomplish this it is necessary to design relays to be assembled so that components thereof can be mounted in a particularly uncomplicated and cost-effective manner and so that, preferably, during the mounting, simple, cost-effective, and fully automatic adjustments, particularly of spaces between relay components, are possible.

An important distance or space for the proper function of a relay is represented by a contact space between a normally-open contact and a movable switch contact arranged on a switch contact spring for a relay that has not been activated.

An electromagnetic relay is known from German Offenlegungsschrift DE-OS 34 23 271 in which an L-shaped beam on a coil frame forms a measuring level. For adjustment of a normally-open contact, this known relay is first placed on a measuring device. Thereafter, by means of a sensing device, various spacings between relay components and the reference level are determined. In a further step, by using these measured spacings, the normally-open contact of the relay is adjusted.

This known relay is thereby constructed in a relatively expensive manner. Also, the measuring and adjusting procedure is relatively complex, since it is carried out by a plurality of series process steps.

A relay with a base plate is already known from German Offenlegungsschrift OS-DE 27 05 961 in which L-shaped fixed contacts are held and with their free ends supported.

It is disadvantageous that the supports are at fixed engagement points with relay components, in particular with an electromagnetic coil frame. Because of this, an exactness of contact spacing is, in turn, dependent upon tolerances of relay components which, as already explained, particularly for microrelays, causes problems. A later adjustment of contact spacing is not provided here.

It is therefore an object of this invention to provide a particularly uncomplicated constructed relay for which an adjustment of contact spacing between switching and normally-open contacts, which adjustment is particularly uncomplicated, cost-effective, and fully automatic, is possible.

SUMMARY

According to principles of this invention, a normally-open contact tongue has at least one finger which engages in a drawer-cavity-forming element of a base plate and is affixed therein.

A particularly stable affixing of the normally-open contact tongue can be achieved by having a plurality of base plate drawer-cavity-forming elements in which a plurality of fingers, extending from a normally-open contact tongue, engage.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the drawings. The drawings are not necessarily to scale, emphasis instead being placed upon illustrating principles of the invention in a clear manner.

DESCRIPTION OF THE PREFERRED EMBODIMENT

Figure 1:
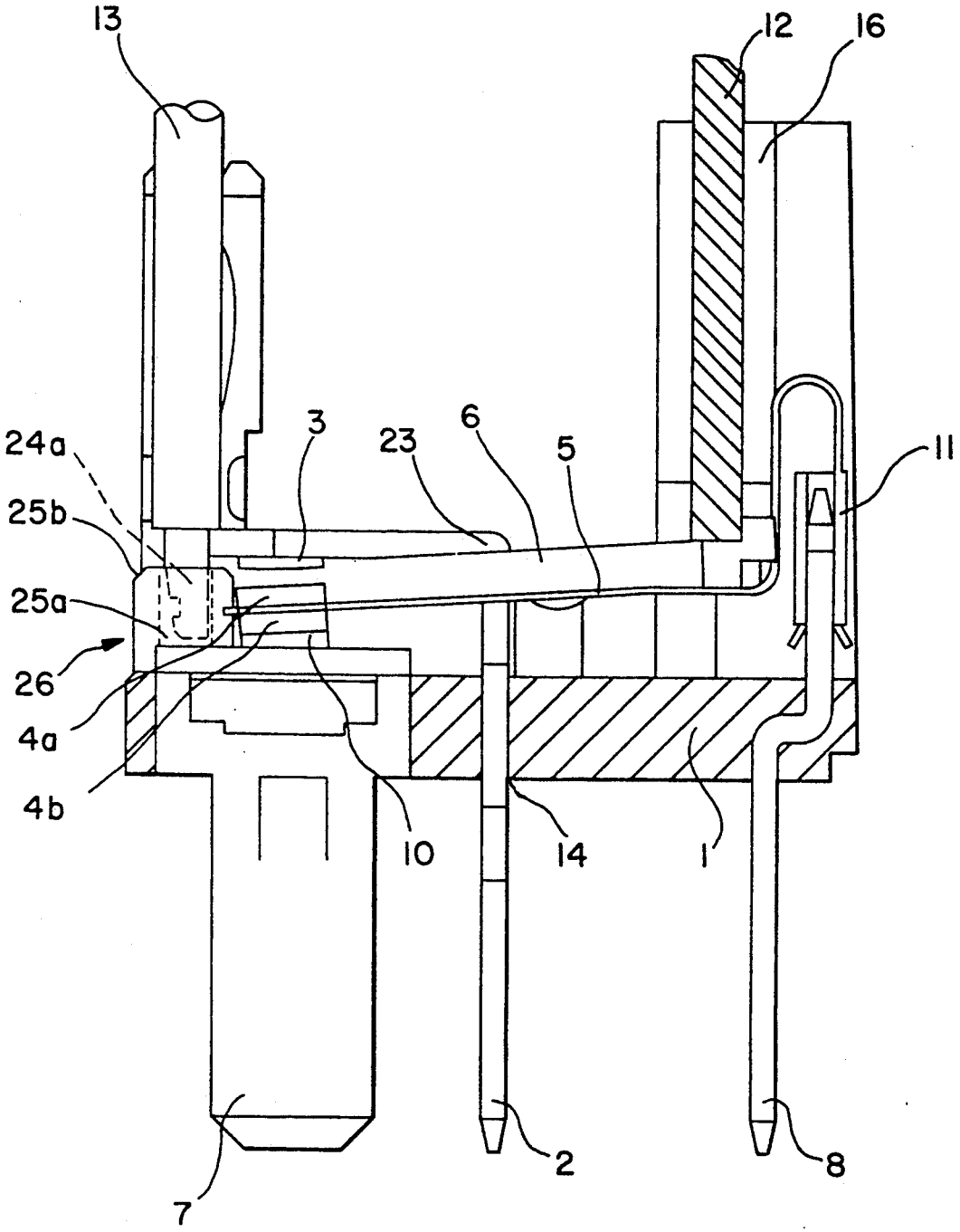
FIG. 1 is a cross-sectional view of a relay according to this invention during assembly thereof.

FIG. 1 shows, in cross section, a relay of this invention which is not yet fully assembled, or fabricated. The relay has a base plate 1 through which a plurality of terminal tongues, or contact tongues, 2, 7, and 8 extend and to which the tongues are affixed. The terminal tongue 7 supports a normally-closed contact 10. A switch-contact spring 5, which is rivetted to an armature 6, is joined to the terminal tongue 8 by means of a connecting element 11. Further, the substantially L-shaped, normally-open contact tongue 2 is inserted into a slot 14 of the base plate 1 and is affixed therein. The normally-open contact tongue 2 has on a short leg thereof a normally-open contact 3.

FIG. 1 shows the relay of this invention during a mounting stage thereof, i.e., during an adjustment of the position of the normally-open contact 3 relative to the position of an upper switch-contact 4*a*. For this, a yoke dummy 12 is shoved into a guiding slot 16 which shoves the armature 6 into approximately a position which it will assume in a fully assembled relay. When this is done, it is important for the lower switch-contact 4*b* to lie on the fixed contact 10.

An adjusting stamp 13 shoves the short leg of the normally-open contact tongue 12 in a direction of the base plate 1 while a measuring apparatus, which is not shown in the drawing, having a calculator associated therewith, monitors a spacing between the normally-open contact 3 and the upper switch-contact 4*a*.

The calculator associated with the measuring apparatus compares the measured spacing with a stored desired spacing and controls movement of the adjusting stamp 13 accordingly. The adjusting stamp 13 shoves, under tension, the short leg of the normally-open contact tongue 2 until the compared spacings correspond.

The normally-open contact tongue 2 has at an end portion of its short leg a finger 24*a* which extends, or engages, in a cavity of a "drawer-cavity-forming" element 25 (that is, an element which resembles a drawer cabinet) which is formed on, or integral with, the base plate 1.

As soon as the normally-open contact 3 reaches a desired position relative to the position of the upper switch contact 4*a*, the at least one finger 24*a* is automatically affixed to the drawer-cavity-forming element 25 in the interior thereof in response to a signal from the measuring apparatus. Because the normally-open contact tongue 2 is normally made of a metal and the base plate 1 as well as its integral members, such as the drawer-cavity-forming element 25, are normally made of a resinous plastic material, ultrasound welding to automatically create deformed weld material is particularly suited to affix the at least one finger 24*a* within the cavity of the drawer-cavity-forming element 25. The affixing of the finger 24*a* can, however, be carried out automatically by means of deformed, or hardened, material created by hot-stamping or by means of a fast-hardening adhesive.

Figure 2:
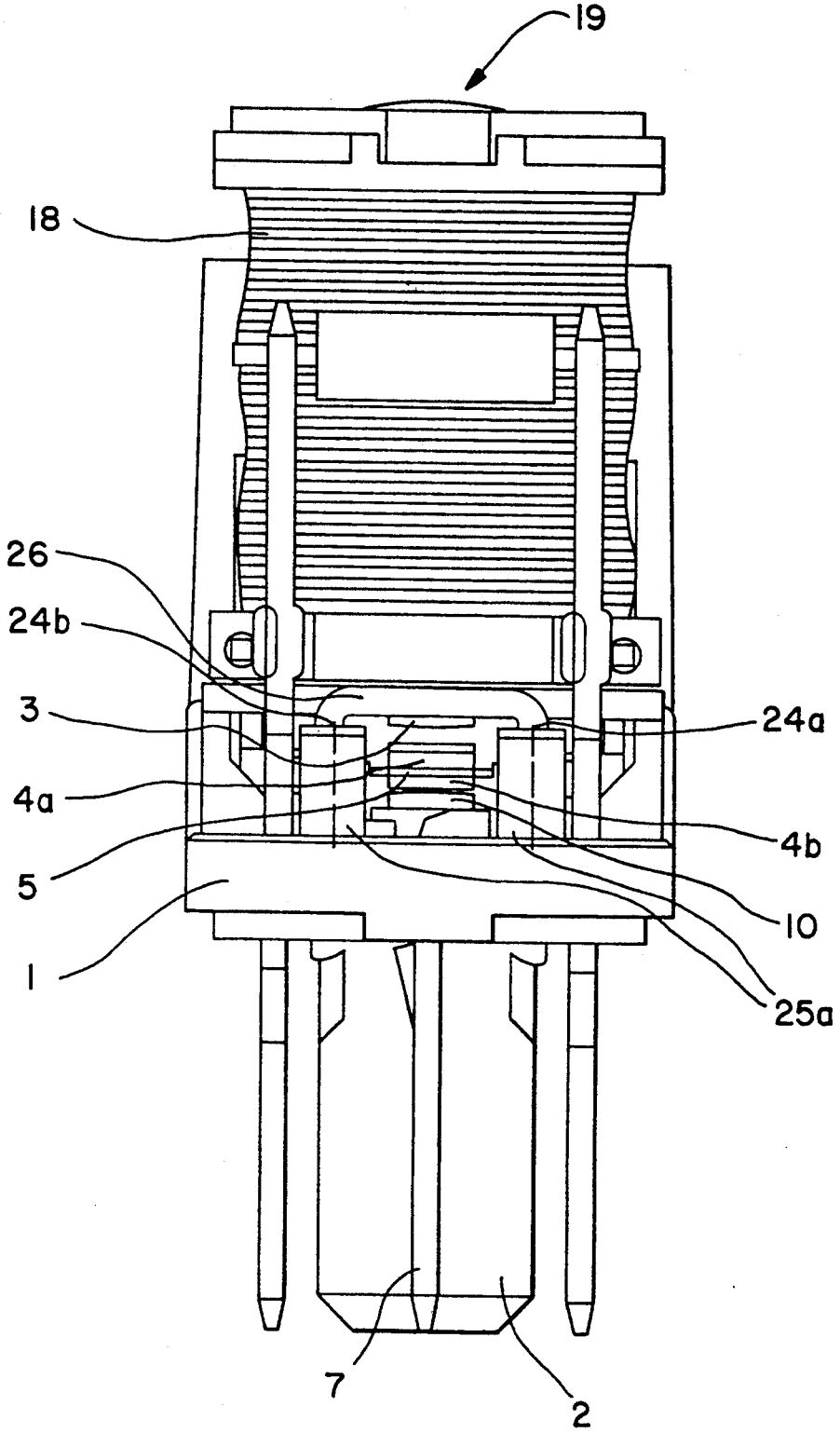
FIG. 2 is a side view, rotated 90° from the FIG. 1 view, of a fully assembled relay.

The arrangement of the relay of this invention is further described with reference to FIG. 2. FIG. 2 shows a view of a fully assembled relay. This Figure shows, in addition to the structure which can be seen in FIG. 1, a magnetic unit which comprises a magnetic coil 18, a coil core, and a magnetic yoke, with the magnetic yoke being rivetted to the coil core. This magnetic unit, which can also be referred to as a yoke-rivet-group 19, is not described here in more detail.

FIG. 2 especially makes clear the affixing of the normally-open contact tongue 2. In this regard, the normally-open contact 2 has at its end portion a substantially U-shaped portion 26 (U-shaped when seen from its end), with fingers 24*a* and 24*b* being legs (which form the fingers 24*a* and *b*) of this U-shaped portion. Both fingers 24*a* and 24*b* extend into the hollow cavities of their drawer-cavity-forming elements 25*a* which are respectively formed on the base plate 1 to have cylindrical or rectangular shapes.

With the fully fabricated relay disclosed in FIG. 2, the fingers 24*a* and 24*b* are already affixed within the cavities of the drawer-cavity-forming elements in the above described manner. Thus, the normally-open contact 3 is fixed in its desired position relative to the movable upper switch contact 4*a*.

In one embodiment, a bent portion of the normally-open contact tongue 2 has a reduced strength relative to adjacent portions of the tongue 2 so that as the position of the short leg is adjusted a pivoting deflection will take place more easily at the bent portion.

The embodiments of the invention in which an exclusive property or privilege are claimed or defined as follows:

1. An electromagnetic relay comprising:

a base plate;

a plurality of terminal tongues extending through said base plate, one of said terminal tongues being a normally-open contact tongue having a normally-open contact thereon, said normally-open contact tongue having a substantially L-shaped bend therein and including at least one finger extending laterally away from a main portion of said normally-open contact tongue;

a drawer-cavity-forming element positioned adjacent said main portion of said normally-open contact tongue for receiving said at least one finger and allowing sliding movement thereof during an adjustment stage of the position of said normally-open contact and including an affixing means for affixing said finger therein when said normally-open contact is in a desired position.

2. An electromagnetic relay as in claim 1 wherein the normally-open contact tongue has two fingers each of which is a portion of a U-shaped element of the normally-open contact tongue, and each of which engages in a drawer-cavity-forming element.

3. An electromagnetic relay as in claim 1 wherein the normally-open contact tongue has a reduced material strength at a bent portion thereof relative to adjacent portions.

4. An electromagnetic relay as in claim 1 wherein said affixing means is deformed weld material created by welding, the at least one finger being affixed in a cavity of the drawer-cavity-forming element by means of the weld material.

5. An electromagnetic relay as in claim 1 wherein the affixing means is an adhesive.

6. An electromagnetic relay as in claim 1 wherein the affixing means is deformed hot stamp material created by means of hot-stamping.

7. A process for the adjustment of components of a relay of a type having a base plate with a plurality of terminal tongues extending therethrough one of which is a normally-open contact tongue thereof supporting a normally-open contact and having a substantially L-shaped bend therein; a switching contact spring including a switch contact and an armature attached thereto; and a magnetic system comprising a magnetic coil, a coil core, and a yoke, said process involving adjustment of the position of the normally-open contact relative to the switch contact and including the steps of:

providing at least one laterally-extending finger on a first leg of the L-shaped normally-open contact on which the normally-open contact is supported;

supporting fixedly on the base plate a drawer-cavity-forming element for defining a cavity with which the at least one finger engages;

with an adjustment stamp, manipulating the first leg of the L-shaped normally-open contact tongue to move the at least one finger along the drawer-cavity-forming element;

with a measuring device, monitoring a spacing between the normally-open contact and the switch contact with the switch contact being in a normally-closed position;

comparing the monitored spacing with a desired spacing;

when the measuring device determines that the monitored spacing corresponds to the desired spacing, automatically issuing a signal from the measuring device to a welding device for welding, and thereby fixing, the at least one finger to the drawer-cavity-forming element.

8. A process as in claim 7 wherein the at least one finger is welded by means of an ultrasound welding apparatus.

9. A process as in claim 7 wherein the at least one finger is welded by means of a hot stamp.

* * * * *